US006997530B2

(12) United States Patent
Avendano et al.

(10) Patent No.: US 6,997,530 B2
(45) Date of Patent: Feb. 14, 2006

(54) FASTENING SYSTEM FOR APPLIANCE CABINET ASSEMBLY

(75) Inventors: Jose G. Avendano, Coal Valley, IL (US); Larry Corbin, Cameron, IL (US)

(73) Assignee: Maytag Corporation, Newton, IA (US)

( * ) Notice: Subject to any disclaimer, the term of this patent is extended or adjusted under 35 U.S.C. 154(b) by 240 days.

(21) Appl. No.: 10/385,607

(22) Filed: Mar. 12, 2003

(65) Prior Publication Data

US 2004/0178707 A1 Sep. 16, 2004

(51) Int. Cl.
*A47B 96/00* (2006.01)

(52) U.S. Cl. ..... 312/401; 312/265.6

(58) Field of Classification Search ..... 312/400, 312/401, 406, 406.1, 406.2, 407, 116
See application file for complete search history.

(56) References Cited

U.S. PATENT DOCUMENTS 2,161,852 A 6/1939 Collins et al.
2,958,210 A 11/1960 Rill., Jr.
3,463,046 A 8/1969 Welch et al.
3,489,477 A 1/1970 Ahrder, Jr.
3,520,581 A 7/1970 Borghi
3,653,532 A 4/1972 Mann
3,789,728 A 2/1974 Shackelford (Continued)

FOREIGN PATENT DOCUMENTS

CA 1056433 6/1979

(Continued)

OTHER PUBLICATIONS

B.F.Goodrich *Rivnuts,* 1952, 19 pages.

*Primary Examiner*—James O. Hansen
(74) *Attorney, Agent, or Firm*—Diederiks & Whitelaw, PLC

(57) ABSTRACT

An appliance cabinet side wall is secured to a front frame member by a first mechanical fastening element of a fastening system. Subsequently, a trim piece is attached along the side wall through the use of a second mechanical fastening element which is threadably connected to the first fastening element. Most preferably, a blind-type rivnut is utilized to prevent any foam, used in insulating the cabinet, from leaking. Utilizing multi-functioning mechanical fastening elements minimizes the number of assembly components, eases assembly and enables the trim piece to be easily removed and/or replaced in case of damage, or even if the consumer desires to simply utilize a trim piece of another color or design.

16 Claims, 3 Drawing Sheets

U.S. PATENT DOCUMENTS

| | | | | | |
|---|---|---|---|---|---|
| 4,040,166 | A | | 8/1977 | Morphy | |
| 4,099,812 | A | | 7/1978 | Morphy | |
| 4,134,627 | A | | 1/1979 | Kuskowski | |
| 4,288,132 | A | | 9/1981 | Znamirowski et al. | |
| 4,632,470 | A | | 12/1986 | Jenkins et al. | |
| 4,676,852 | A | | 6/1987 | Gidseg | |
| 4,732,432 | A | | 3/1988 | Keil et al. | |
| 4,820,372 | A | | 4/1989 | Gidseg | |
| 4,822,117 | A | | 4/1989 | Boston, Jr. | |
| 4,948,206 | A | | 8/1990 | Fitzpatrick | |
| 4,970,874 | A | * | 11/1990 | Solak et al. | 62/258 |
| 5,265,954 | A | | 11/1993 | Keil | |
| 5,269,099 | A | | 12/1993 | Kennedy et al. | |
| 5,403,135 | A | | 4/1995 | Renner et al. | |
| 5,472,270 | A | * | 12/1995 | Czarnecky et al. | 312/265.6 |
| 5,584,551 | A | | 12/1996 | Jenkins | |
| 5,588,731 | A | | 12/1996 | Schmidt et al. | |
| 5,720,536 | A | | 2/1998 | Jenkins et al. | |
| 5,899,546 | A | | 5/1999 | Avendano et al. | |
| 6,036,293 | A | | 3/2000 | Anell et al. | |

FOREIGN PATENT DOCUMENTS

| | | | |
|---|---|---|---|
| GB | 671283 | | 4/1952 |
| KR | 2002-52255 | * | 9/2002 |

* cited by examiner

FASTENING SYSTEM FOR APPLIANCE CABINET ASSEMBLY

BACKGROUND OF THE INVENTION

1. Field of the Invention

The present invention pertains to the art of appliances and, more particularly, to a fastening system for use in interconnecting, during varying stages of an overall assembly process, main and trim components of an overall appliance cabinet.

2. Discussion of the Prior Art

In constructing an appliance cabinet, particularly a refrigerator cabinet, it is highly desirable to simplify the overall assembly of the cabinet to reduce manufacturing costs, yet it is imperative that the cabinet be structurally sound in order to counteract loads exerted thereon during use of the appliance. Mainly due to cost efficiencies and flexibility in workmanship, it has been commonplace to utilize sheet metal in the forming of most refrigerator cabinets in the market today. Since the sheet metal is thin and rather high loads are often placed on the cabinet, particularly by the opening and closing of a weighted down refrigerator door, a fair amount of effort has been applied in this art to provide reinforcement for such a refrigerator cabinet. Of course, an additional concern is the ease of assembly of the cabinet as a whole.

With this in mind, it has heretofore been proposed to form the sides and top of a refrigerator cabinet shell out of a single piece of bent sheet metal and then attach rear and bottom walls. Thereafter, the shell is structurally reinforced in an attempt to avoid deformation during use. Such known reinforcing arrangements generally take the form of either providing multiple, individually secured reinforcement members or a unitary reinforcing frame at a front opening of the cabinet shell. At least the sides of the shell are attached to the frame to integrate the overall assembly. To perform this assembly operation, either various holes provided in both the cabinet shell and the reinforcement member(s) must be aligned to receive mechanical fasteners or systematic welding operations are performed. In either case, these connections are designed to perform the sole function of interconnecting the shell to the reinforcement structure.

In today's market, it is becoming more popular to recess refrigerators between adjacent cabinetry or the like in a kitchen area in order to provide a built-in look which is considered aesthetically appealing. Since front doors of a refrigerator must be spaced from any adjacent structure in order to enable the free pivoting of the doors, the refrigerator must project from the adjacent structure to some degree. Unfortunately, the projecting of the refrigerator cabinet in this manner exposes, to a certain degree, frontal portions of the side walls of the cabinet which is considered to detract from the built-in appearance.

To compensate for this negative effect, it has been proposed to provide cosmetic trim pieces along exposed side portions of the cabinet to blend the sides with the adjacent structure. In such known arrangements, the trim pieces are individually attached to the cabinet shell through slip-fit or dedicated mechanical connections. Since both sides of the shell and the trim pieces need to be attached to the frame structure, all at a frontal peripheral portion of the cabinet shell, a fairly high number of connection locations need to be defined in a relatively small zone which can adversely affect the structural integrity. In addition, the need for the unrelated connections in this peripheral portion simply adds to the overall assembly time.

Based on the above, there exists a need in the art for an improved assembly arrangement for a refrigerator cabinet which minimizes the cost and time associated with connecting both side portions of a shell to one or more frontal frame members and trim pieces to the side portions.

SUMMARY OF THE INVENTION

The present invention is particularly directed to a fastening system used to secure an appliance cabinet side wall or panel to a front frame member and in subsequently securing a trim piece to the frame member along the side wall. In general, the attachment of the cabinet side wall occurs prior to a foaming insulation process, while the trim piece is attached at a much later assembly stage. Regardless, the fastening stages are interrelated through the use of at least certain common fastening elements, of the fastening system.

In accordance with a preferred embodiment of the invention, rivnuts are used to secure the cabinet front frame and each side wall together. After assembly of the cabinet shell, the foaming operation is performed. Most preferably, blind-type rivnuts are utilized to prevent any foam insulation leakage directly through or around the perimeter of the rivnuts. After the foaming process, a threaded internal portion of each rivnut is utilized to attach a respective perimeter trim piece to the cabinet shell through a respective screw. Utilizing screws to attach the trim piece enables the trim piece to be easily removed and/or replaced in case of damage, or even if the consumer desires to simply utilize a trim piece of another color or design.

Additional objects, features and advantages of the present invention will become more fully apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
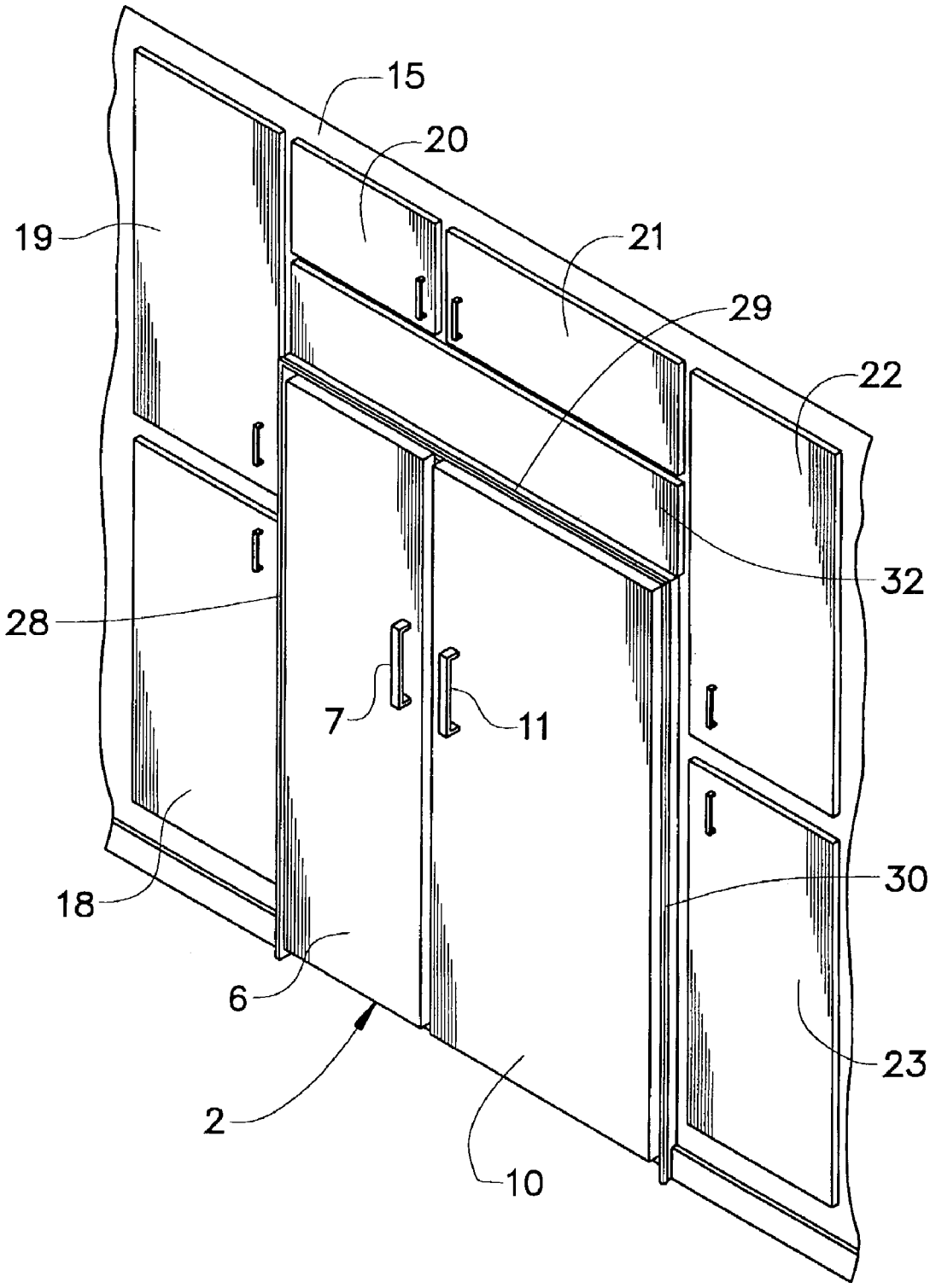
FIG. 1 illustrates a recessed refrigerator cabinet assembly incorporating trim pieces fastened in accordance with the present invention.

With initial reference to FIG. 1, a refrigerator constructed in accordance with the present invention is generally indicated at 2. Refrigerator 2 is shown to include a freezer door 6 having an associated handle 7 and a fresh food door 10 having an associated handle 11. In the embodiment shown, refrigerator 2 is of the recessed type such that, essentially, only freezer and fresh food door 6 and 10 project forward of a wall 15. The remainder of refrigerator 2 is recessed within wall 15 in a manner similar to a plurality of surrounding cabinets generally indicated at 18–23. Refrigerator 2 also includes a plurality of peripheral trim pieces 28–30. In accordance with the most preferred embodiment of the invention, trim pieces 28–30 are formed of aluminum.

However, other materials, such as plastic, could also be utilized. The configuration and mounting of trim pieces 28–30 form an aspect of the present invention as will be detailed more fully below. Finally, it should be noted that refrigerator 2 is preferably designed with main components of a refrigeration system positioned behind an access panel 32 arranged directly above trim piece 29 as clearly shown in this Figure.

Figure 2:
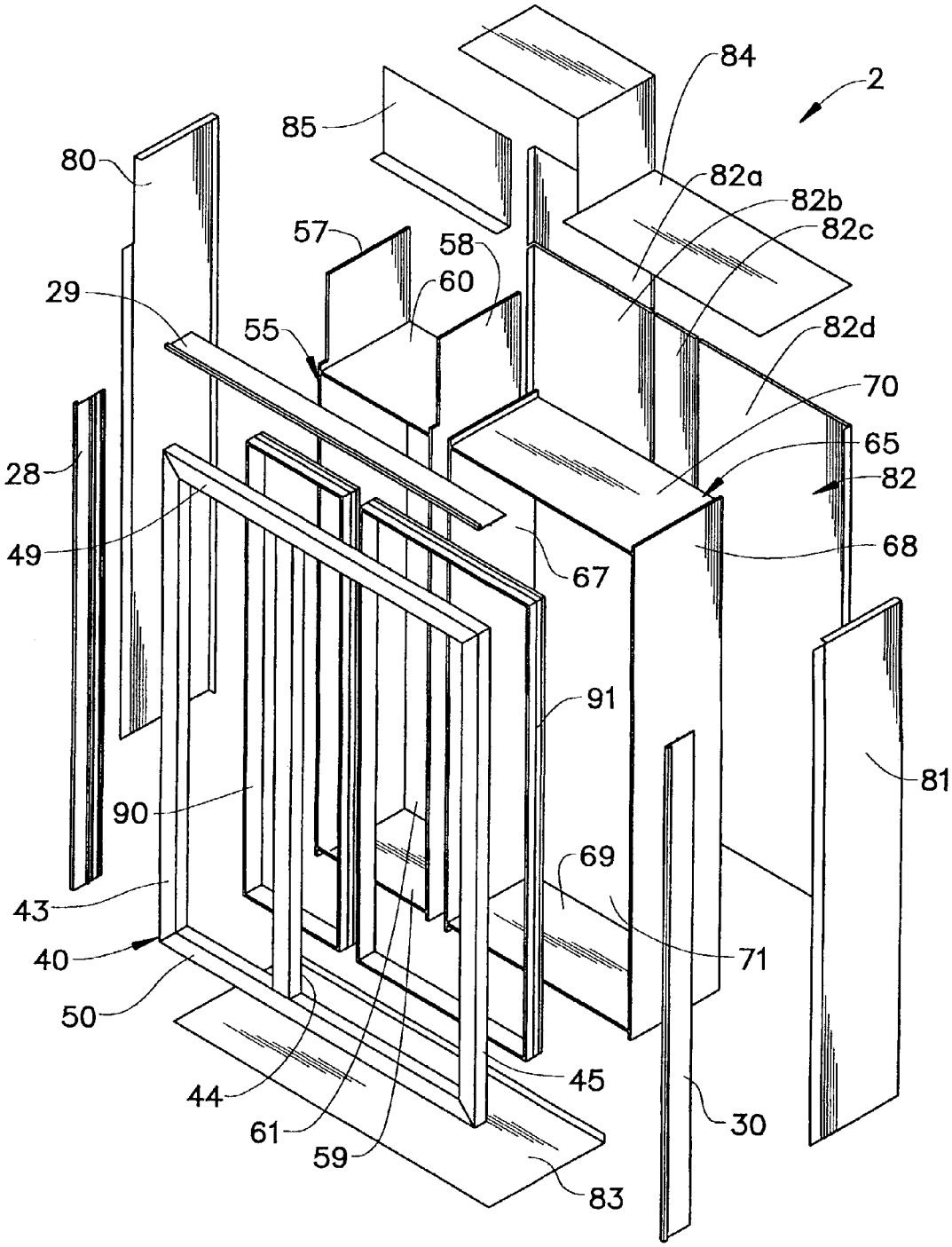
FIG. 2 is an exploded view of the refrigerator cabinet assembly of the invention.

Although refrigerator 2 can take various forms, FIG. 2 represents, in exploded view form, the main cabinet components of refrigerator 2. As illustrated, refrigerator 2 includes a front frame 40 including a plurality of laterally spaced upstanding frame members 43–45 which are interconnected by upper and lower cross frame members 49 and 50. Refrigerator 2 also includes a freezer compartment box 55 defined by interconnected side, bottom, top and back panels 57–61. In a similar fashion, a fresh food compartment box 65 is formed from side, bottom, top and back panels 67–71. As freezer compartment box 55 and fresh food compartment box 65 are preferably formed as separate units, they are integrated into an overall refrigerator cabinet assembly by front frame 40 and an outer shell as defined by side walls 80 and 81, a back wall 82 which is preferably defined by four separate panels 82*a*–82*d*, a bottom wall 83, a top cover member 84 and a front cover member 85. As will be detailed more fully below, front frame 40 is adapted to be attached to forward portions of each of side walls 80 and 81 such that, front frame 40, freezer compartment box 55, fresh food compartment box 65, side walls 80, 81, back wall 82, bottom wall 83, top cover member 84 and front cover member 85 are all integrated together. Also provided about openings (not separately labeled) defined by front frame 40 are associated peripheral breaker elements 90 and 91 that are adapted to cooperate with freezer door 6 and fresh food door 10 in defining sealed freezer and fresh food compartments within boxes 55 and 65 respectively.

For the sake of simplicity, the various components of a conventional refrigeration circuit have not been shown. However, with this configuration of refrigerator 2, the various compressor, condenser, evaporator and the like components are preferably supported upon top panel 60 of freezer compartment box 55, as well as top cover member 84. In accordance with the most preferred embodiment of the invention, the evaporator is supported above freezer compartment box 55 while the compressor and condenser are located above fresh food compartment box 65, with each of these components being accessible upon removing access panel 32.

Figure 4:
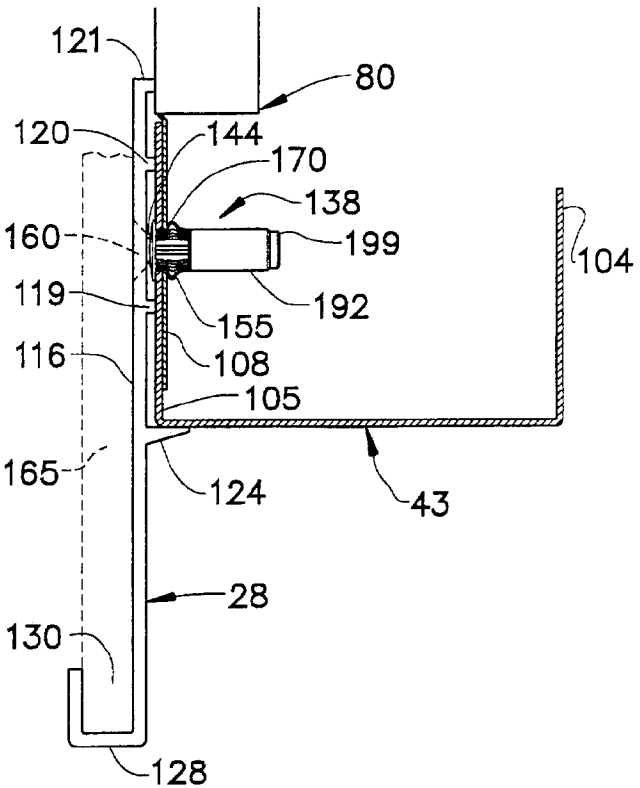
FIG. 4 is a top, assembled view of the fastening system of FIG. 3.
Figure 3:
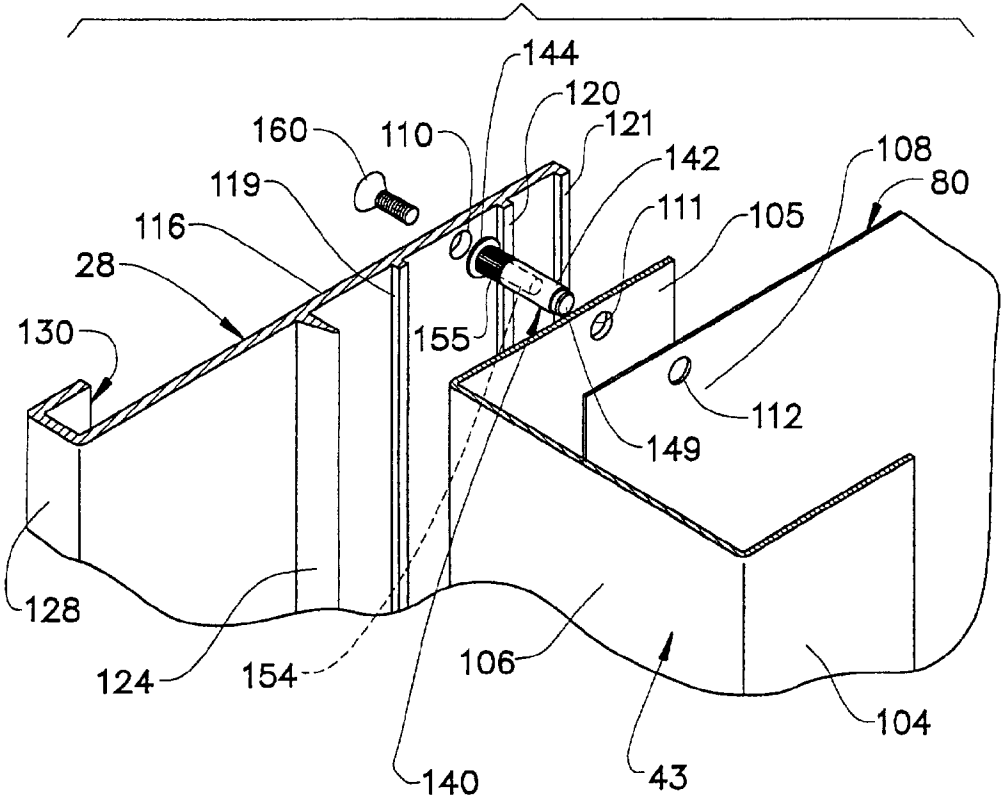
FIG. 3 is an enlarged, exploded view of a portion of the refrigerator cabinet assembly of FIG. 2 showing the components of the overall fastening system in detail.

The present invention is particularly directed to the preferred manner in which front frame 40 is interconnected to each of side walls 80 and 81, top cover member 84 and front cover member 85, along with the manner in which trim pieces 28–30 are also attached to these components. Specifically, with reference to FIGS. 3 and 4, there is shown, by way of example, a section of side wall 80, a portion of upstanding frame member 43 and a section of trim piece 28. The manner in which these components are interconnected will now be described in detail and it is to be understood that corresponding connections are utilized for the other, identified components. As shown, upstanding frame member 43 generally takes the form of a U-shaped channel defined by inner and outer legs 104 and 105 which are interconnected by a front leg 106. Outer leg 105 wraps around a front portion 108 of side wall 80. Trim piece 28, outer leg 105 and side wall 80 are formed with respective, aligned apertures 110–112. Trim piece 28 includes a main body 116 formed with a plurality of elongated spaced ribs 119–121 projecting toward side panel 80 and outer leg 105. Spaced forward from ribs 119–121, main body 116 has projecting therefrom a flange 124. The forwardmost end 128 of trim piece 28 is in-turned so as to define a channel 130.

The manner in which front frame 40, sidewall 80 and trim piece 28 are interconnected together in accordance with the present invention includes the use of a rivnut 138. Rivnut 138 includes a first fastening element 140 having a cylindrical main body 142. A first end 144 of main body 142 is flared, while a second end 149 is tapered. First end 144 is preferably open such that main body 142 defines an internal bore 154 that is threaded. On the other hand, second end 149 is preferably closed such that rivnut 138 is of the blind-type. As also shown, main body 142 of first fastening element 140 includes an outer splined portion 155 directly adjacent the flared first end 144. Rivnut 138 also includes a second mechanical fastening element 160 that takes the form of a flat-head screw.

At this point, it should be noted that rivnuts are known in the art. However, in accordance with the present invention, each rivnut 138 is advantageously utilized to interconnect multiple components of refrigerator 2 during different stages of the overall construction, while minimizing components and overall assembly time and cost. In any event, cylindrical main body 142 is adapted to interconnect outer leg 105 of front frame 40 to sidewall 80 by extending through apertures 111 and 112 respectively and then being pressed into place such that both outer leg 105 and sidewall 80 become positioned directly adjacent to flared first end 144 along outer spline portion 155. A tool is then used to collapse rivnut 138 at outer spline portion 155 to form a throat 170 that holds outer leg 105 and sidewall 80 together between the flared first end 144 and the bulging section of outer spline portion 155. This configuration is clearly shown in FIG. 4. Due to the tapering of second end 149, the insertion of cylindrical main body 142 through, as well as the alignment of, apertures 111 and 112 is enhanced. Furthermore, since second end 149 of main body 142 is closed, foam insulation can be injected between compartment boxes 55, 56 and sidewalls 80, 81, backwall 82, top cover member 84 and front cover member 85 for insulation purposes. The use of foamed insulation is also widely known in the art of refrigerators and therefore this operation will not be discussed in detail. However, it will be readily recognized that the foam can essentially be injected at one location and will meander through all cracks and crevices. Thereafter, when the foam cures, considerable structural integrity is given to the overall refrigerator 2. Given that second end 149 is closed, injected foam will not be able to leak through cylindrical main body 142.

During a latter stage of assembly, trim piece 28 can be positioned such that each aperture 110 provided therein gets aligned with a respective internal bore 154 such that second fastening element 160 can be threadably attached to first fastening element 140. Therefore, in this manner, cylindrical main body 142 functions not only as the fastening member between front frame 40 and sidewall 80, but also as an anchor for trim piece 28. When trim piece 28 is secured in this fashion, spacer ribs 119–121 accommodate flared first end 144 of first fastening element 140 and abut against a respective one of sidewall 80 and outer leg 105 as clearly shown in FIG. 4. In addition, flange 124 extends in front of and preferably abuts front leg 106 of front frame 40 to visually close off the gap created by spacer ribs 119–121. Although not specifically shown in FIG. 4, it should be realized that the area forward of front leg 106 and to the side of trim piece 28 is later occupied by freezer door 6.

Therefore, the thickness of freezer door 6, along with an associated sealing breaker (not shown), is used to define the preferred extent to which trim piece 28 projects forward of front frame 40. With the inclusion of channel 130, a decorative panel 165 can be readily connected to the overall refrigerator 2 in order to blend with a remainder of cabinets 18–23. That is, trim pieces 28–30 and/or decorative panel 165 can be of different colors which can be selected by the consumer. In any event, the overall use of trim pieces 28–30 to cover exterior facing surfaces (not separately lebeled) of side walls 80 and 81, top cover member 84 and front cover member 85 and decorative panel 165 provides a further built-in look to refrigerator 2 which is considered to be advantageous in accordance with the present invention.

Although described with respect to a preferred embodiment of the invention, it should be readily understood that various changes and/or modifications can be made to the invention without departing from the spirit thereof. Particularly, it should be realized that the fastening system of the invention has applicability to various types of refrigerators, as well as other appliances. In any event, the invention is only intended to be limited by the scope of the following claims.

We claim:

1. An appliance cabinet assembly comprising:

an outer cabinet shell including a pair of laterally spaced, upright side walls and a top wall, each of said side and top walls including a respective forward portion having an exterior facing surface, said outer cabinet shell defining at least one interior compartment adapted to house items in a controlled environment;

a structural reinforcing frame member extending upwardly adjacent the forward portion of one of the side walls;

an elongated exterior trim piece extending along the forward portion of said one of the side walls; and a mechanical fastening unit including a first fastening element connecting the forward portion of said one of the side walls to the structural reinforcing frame member and a second fastening element attaching the elongated exterior trim piece to the exterior facing surface of the forward portion of said one of the side walls, with said second fastening element extending through the elongated exterior trim piece and being directly interconnected to the first fastening element.

2. The appliance cabinet assembly according to claim 1, wherein said structural reinforcing frame member constitutes part of an integrated structural reinforcing frame fixed at the forward portion of each of the side and top walls.

3. The appliance cabinet assembly according to claim 1, wherein said mechanical fastening unit comprises a rivnut.

4. The appliance cabinet assembly according to claim 3, wherein the first fastening element of the rivnut includes an externally splined portion.

5. The appliance cabinet assembly according to claim 3, wherein said rivnut constitutes a blind-type rivnut.

6. The appliance cabinet assembly according to claim 3, wherein said first fastening element is formed with an internally threaded bore for receiving an externally threaded portion of said second fastening element.

7. The appliance cabinet assembly according to claim 6, wherein the internally threaded bore includes an open end adapted to receive the second fastening element and an opposing, closed end.

8. The appliance cabinet assembly according to claim 1, wherein said first fastening element is formed with an internally threaded bore for receiving an externally threaded portion of said second fastening element.

9. The appliance cabinet assembly according to claim 8, wherein the internally threaded bore includes an open end adapted to receive the second fastening element and an opposing, closed end.

10. The appliance cabinet assembly according to claim 8, wherein the first fastening element includes an externally splined portion.

11. The appliance cabinet assembly according to claim 1, wherein the elongated exterior trim piece projects forward of said one of said side walls.

12. The appliance cabinet assembly according to claim 11, wherein said elongated exterior trim piece includes a laterally outwardly extending channel forming member adapted to receive a decorative side panel.

13. The appliance cabinet assembly according to claim 1, wherein the elongated exterior trim piece includes a main body and a plurality of ribs projecting from the main body, with said plurality of ribs spacing the elongated exterior trim piece from said one of the side walls.

14. The appliance cabinet assembly according to claim 13, wherein said elongated exterior trim piece is formed of aluminum.

15. The appliance cabinet assembly according to claim 14, wherein the elongated exterior trim piece further includes a frontal flange projecting from the main body.

16. The appliance cabinet assembly according to claim 15, wherein the front flange abuts the structural reinforcing frame member.

* * * * *